United States Patent [19]

Allen et al.

[11] Patent Number: 4,893,712

[45] Date of Patent: Jan. 16, 1990

[54] CAN PACKAGES

[75] Inventors: Fred C. Allen, Waterville; Scott W. Steele, Perrysburg, both of Ohio

[73] Assignee: Owens-Illinois Plastic Products Inc., Toledo, Ohio

[21] Appl. No.: 239,934

[22] Filed: Sep. 2, 1988

Related U.S. Application Data

[60] Division of Ser. No. 106,941, Oct. 14, 1987, which is a continuation of Ser. No. 908,444, Sep. 17, 1986, abandoned.

[51] Int. Cl.[4] ..... B65D 7/06; B65D 75/56

[52] U.S. Cl. ..... 206/150

[58] Field of Search ..... 206/139–161, 206/428, 432, 434

[56] References Cited

U.S. PATENT DOCUMENTS

| | | | |
|---|---|---|---|
| 2,842,304 | 7/1958 | Ringler | 206/428 |
| 2,853,186 | 9/1958 | Holmberg | 206/145 X |
| 3,302,783 | 2/1967 | Lyon | 206/150 |
| 3,513,970 | 5/1970 | Eckholm, Jr. | 206/150 |
| 4,269,308 | 5/1981 | Platt | 206/150 |
| 4,269,314 | 5/1981 | Barrash | 206/150 X |
| 4,582,199 | 4/1986 | Schuster | 206/428 |
| 4,628,666 | 12/1986 | Lems | 206/150 X |
| 4,828,110 | 5/1989 | Lems | 206/150 X |

FOREIGN PATENT DOCUMENTS

| | | | |
|---|---|---|---|
| 2028755 | 3/1980 | United Kingdom | 206/432 |
| 2107269 | 4/1983 | United Kingdom | 206/141 |

*Primary Examiner*—William Price

[57] ABSTRACT

A can package comprising a plurality of cans, preferably twelve, including a flat carrier in the form of a sheet having openings stretched over the upper ends of the cans and a tubular banding strap of plastic material stretched about the periphery of the group of cans and bonded along one edge to the periphery of the carrier. The band includes an integral handle.

8 Claims, 6 Drawing Sheets

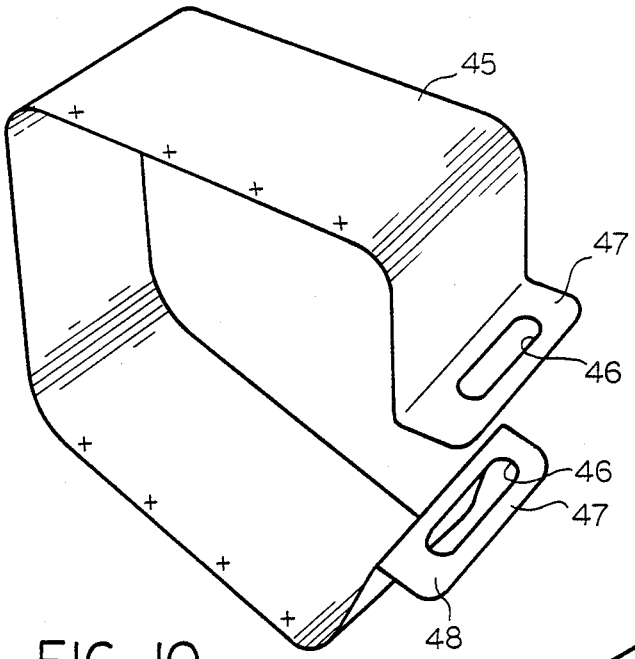
FIG. 10
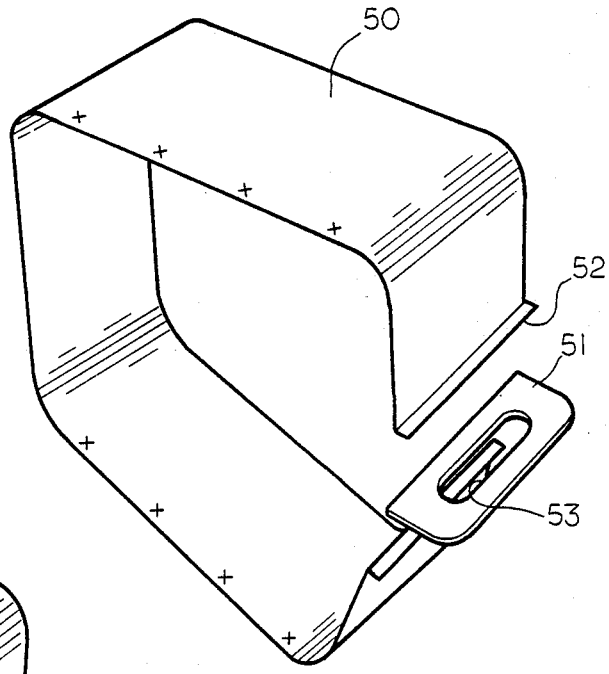
FIG. 11
FIG. 12
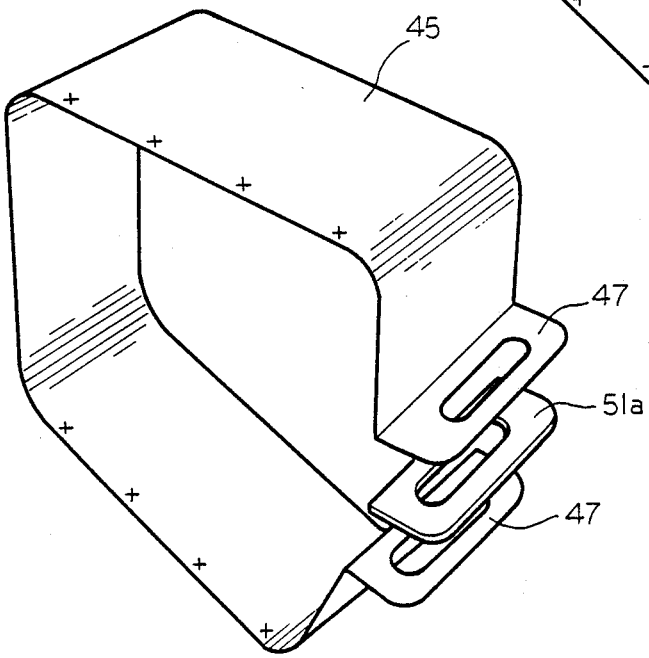

CAN PACKAGES

This is a divisional of co-pending application Ser. No. 106,941 filed on Oct. 14, 1987 which is, in turn, a continuation of application Ser. No. 908,444 filed Sept. 17, 1986, now abandoned.

This invention relates to can packages and particularly to packages comprising a plurality of cans in a group, preferably twelve cans.

BACKGROUND AND SUMMARY OF THE INVENTION

In the packaging of cans and particularly groups of cans in large numbers, such as twelve cans, it is common to utilize a chipboard package. The chipboard package provides a method of handling the large number of cans as well as provides a large visual display area for promotional graphics and the like. In such a package, a carton is formed from a printed sheet, expanded, filled with cans and then the carton is sealed to completely enclose the cans. Where the user wishes to remove cans, the carton is opened and the cans are removed. Such a package is strong when dry but weak when wet. Furthermore, the empty carton poses a large cumbersome disposal problem.

The use of handles in association with various types of carriers for bottles and cans is old as shown, for example, in U.S. Pat Nos. 3,232,422, 3,259,959, 3,302,783, 3,307,321, 3,330,408, 3,608,949, 3,653,504, and 4,269,308. The present invention provides a package which differs from these patents and has advantages thereover.

Accordingly among the objectives of the present invention are to provide a can package for cans in large numbers, such as twelve cans, which utilizes a conventional flat plastic carrier over the ends of the cans and a wide band about the bodies of the cans which results in a package that facilitates the handling of the group of cans and at the same time provides ample space for promotional graphics and the like; which carrier also includes a handle; which is durable when wet; which utilizes a minimum of material which is less bulky minimizing the problem of disposal: which provides a more attractive glossy surface for display of graphics; which can utilize existing equipment for applying the carrier on the ends of the cans; which completely protects the cans from abrasion and clearly distinguishes the number of cans in the package; and which is low in cost.

In accordance with the invention, a can package comprising a plurality of cans, preferably twelve, including a flat carrier in the form of a sheet having openings stretched over the upper ends of the cans and a banding strap of plastic material stretched about the periphery of the group of cans and bonded along one edge to the periphery of the carrier. The band includes an integral handle.

DESCRIPTION OF THE DRAWINGS

FIG. 10 is a perspective view of a partially assembled view of another modified form of can package.

FIG. 11 is a perspective view of a partially assembled view of another modified form of can package.

FIG. 12 is a perspective view of a partially assembled view of another modified form of can package.

DESCRIPTION

Referring to FIGS. 1–4, the can package 10 embodying the invention includes a plurality of cans C, herein shown as twelve in number, arranged in three rows of four cans each, a carrier 11 of plastic material shown in position on the ends of the cans C and a band 12 stretched about the cans and welded to the carrier 11 as at 13 adjacent each can along longitudinally spaced points on the short side of the array of cans and the band.

Figure 1:
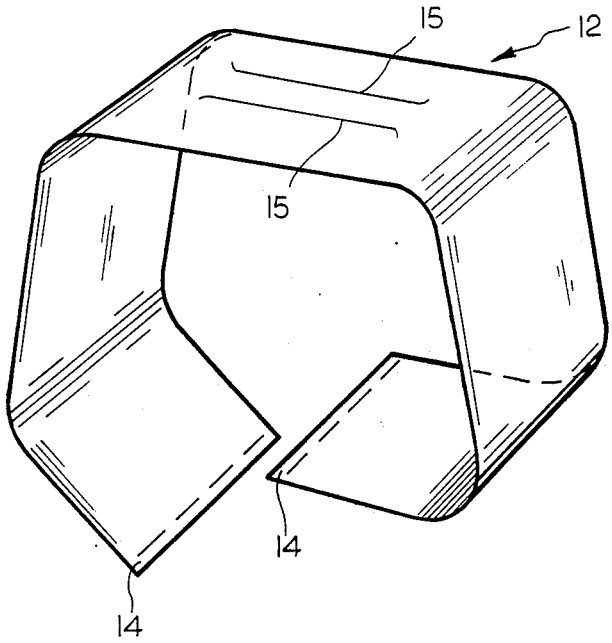
FIG. 1 is an exploded view of a band utilized in the package of FIG. 2.
Figure 2:
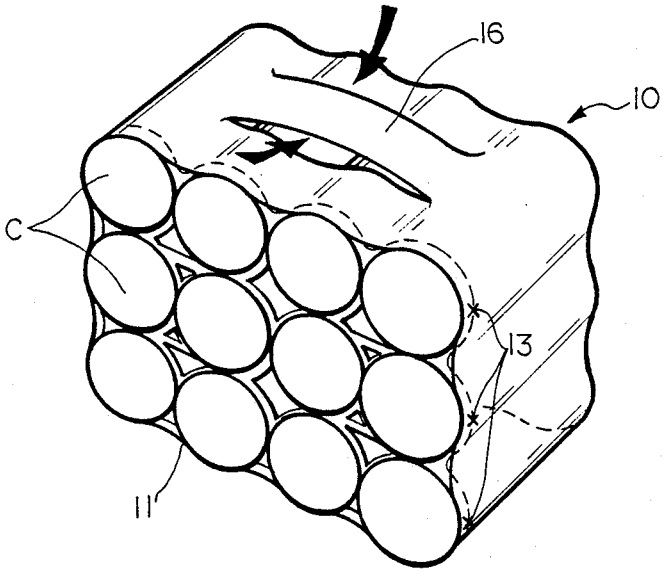
FIG. 2 is a perspective view of a can package embodying the invention.
Figure 3:
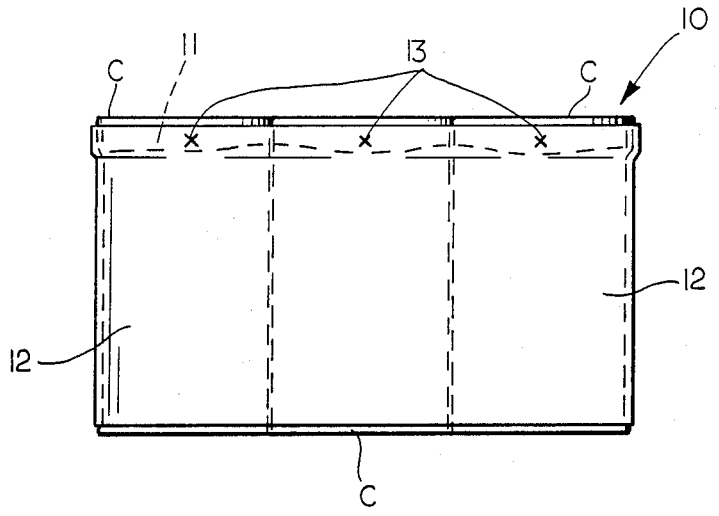
FIG. 3 is an elevational view of the can package shown in FIG. 2.

Band 12 comprises a single rectangular plastic sheet that has its ends bonded in overlapping relation as shown in FIG. 1. The carrier 11 is first placed over the ends of the cans and then the band 12 is stretched over the sides of the cans with the overlapping ends 14 preferably positioned along the long side of the group of cans, that is, along the side formed by four cans. The nature of the carrier 11 is such that portions of the carrier extend along the sides of the outermost cans and the band 12 overlaps these portions. The width of the band 12 is equal to the height of the cans and preferably such that the upper edge of the stretched band extends below the double seamed closure and into the conventional neck or shoulder and the lower edge extends inwardly slightly below the heel. In this manner, the side edges of the band are less subject to engagement by machining or handling apparatus and thus less subject to tearing in use. To complete the package, the band is bonded to these portions, as by ultrasonic welding. Preferably, the bonding is along two parallel sides.

The band 12 is formed with spaced slits 15, extending lengthwise of the carrier to define a handle 16 along the long side of the group of cans. The handle 17 can be grasped to carry the can package.

Where the handle is along the long sides, the bonding is along the short sides. Where the handle is along a short side, the bonding is along a long side.

Figure 4:
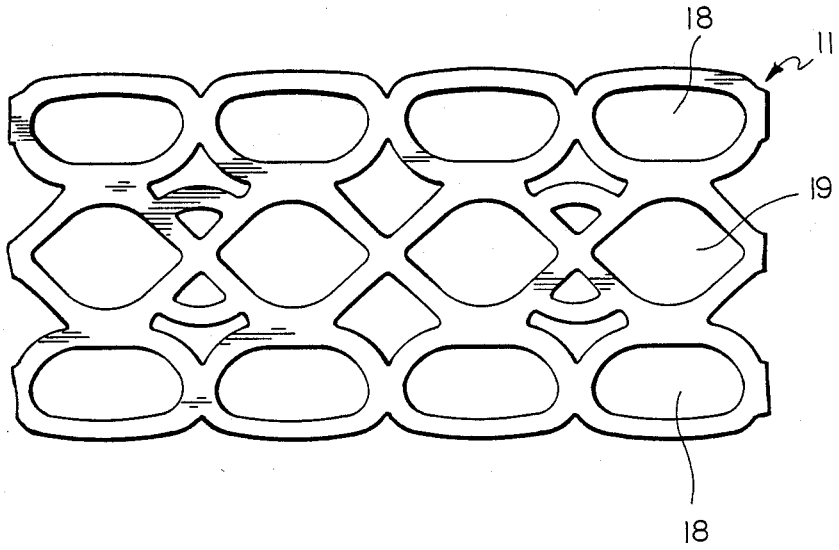
FIG. 4 is a plan view of the carrier utilized in each of the forms of the package.

Referring to FIG. 4, the carrier 11 is made of a flat sheet of plastic material having a plurality or array of elongated openings 18, 19, corresponding in number to the number of cans in the package. Such a carrier is old and well known. When stretched on the ends of the cans a portion of such a carrier projects axially along the sides of the cans. As indicated above, when the band is applied, the portions of the carrier are in underlying relationship to the band and the band is then bonded to the carrier portions at the areas 13.

The carrier 11 and band 12 are made of a plastic material such as polyethylene. Preferably, the machine direction of the plastic in the band is transverse, namely, in the direction of the height of the containers. Where the handle has a single thickness, the band preferably has a thickness of 7–10 mils.

Figure 6:
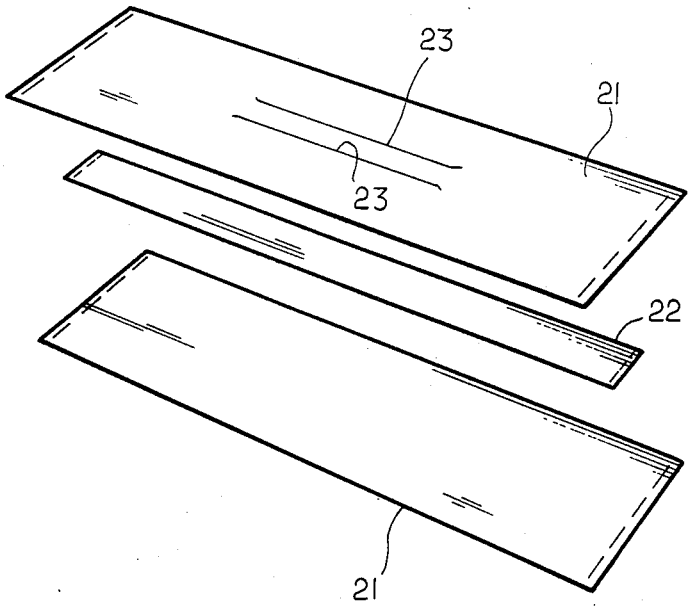
FIG. 6 is a perspective expanded view of the band utilized in the package of FIG. 5.
Figure 5:
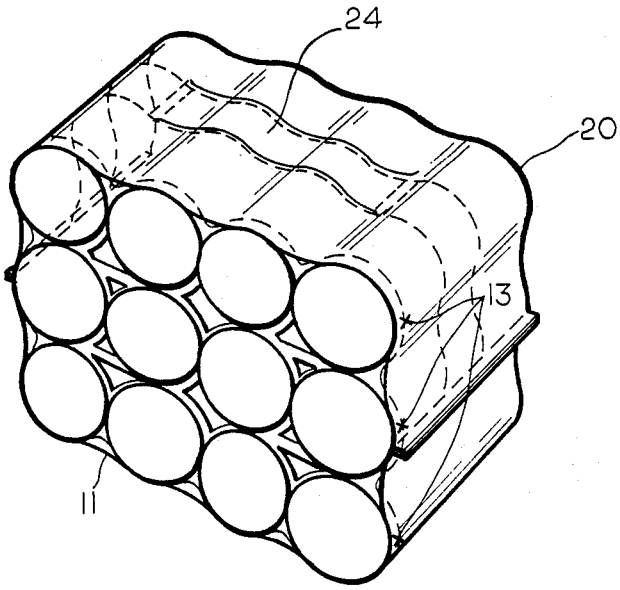
FIG. 5 is a perspective view of a further modified form of can package.

In the form shown in FIGS. 5 and 6, the band 20 comprises walls or layers 21, 21 which have a width substantially equal to the length of the cans and the width of a layer 22 is a portion of the width of the layers 21, 21 such that it is accessible through slits 23 in a layer 21 to provide a double layer handle 24 that can be grasped for carrying the package. Where the handle has two thicknesses or layers, the thickness of the band is preferably 4–6 mils.

Figure 7:
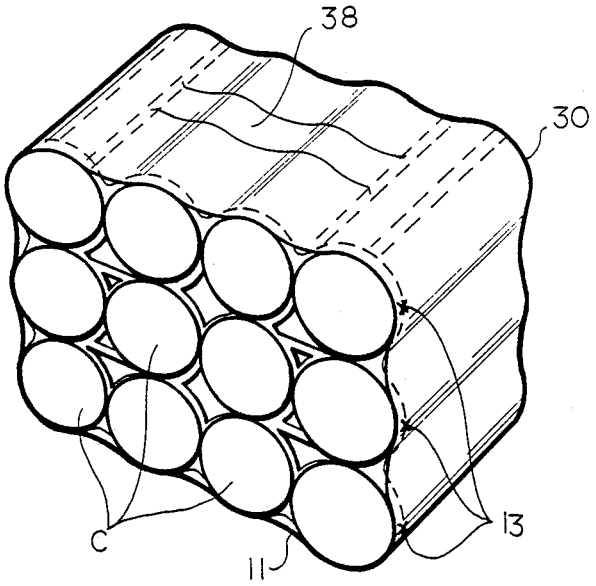
FIG. 7 is a perspective view of a further form of can package.
Figure 8:
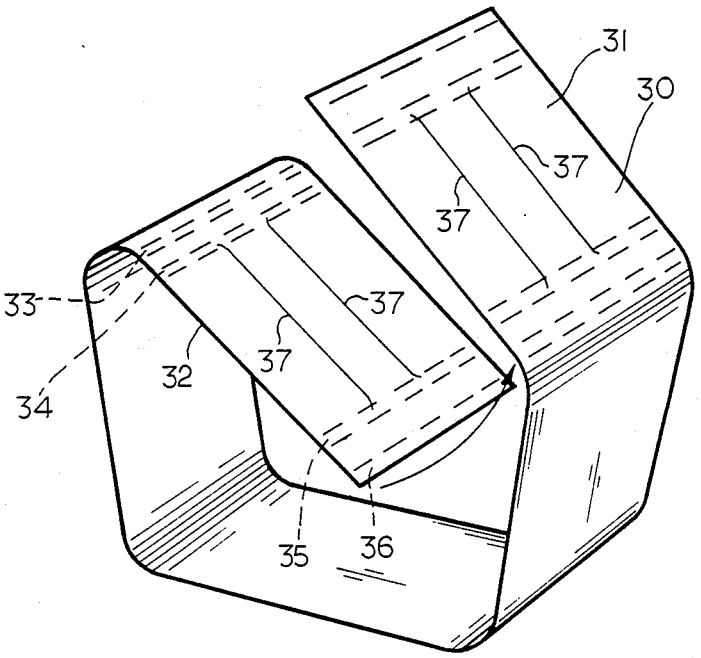
FIG. 8 is a perspective expanded view of the band utilized in the package shown in FIG. 7.

In the form of the invention shown in FIGS. 7 and 8, the band 30 comprises a single layer of material that has its ends 31, 32 folded into overlapping relationship and bonded along portions 33, 34 spaced from the end and portions 35, 36 adjacent the end to complete one side of the band where there are two layers. The overlapping portions 31, 32 are slotted along lines 37 after the end portions 31, 32 are bonded to define elongated handle portion 38 which overlie one another and can be grasped to form a double layer handle 38 for carrying the can package.

Figure 9:
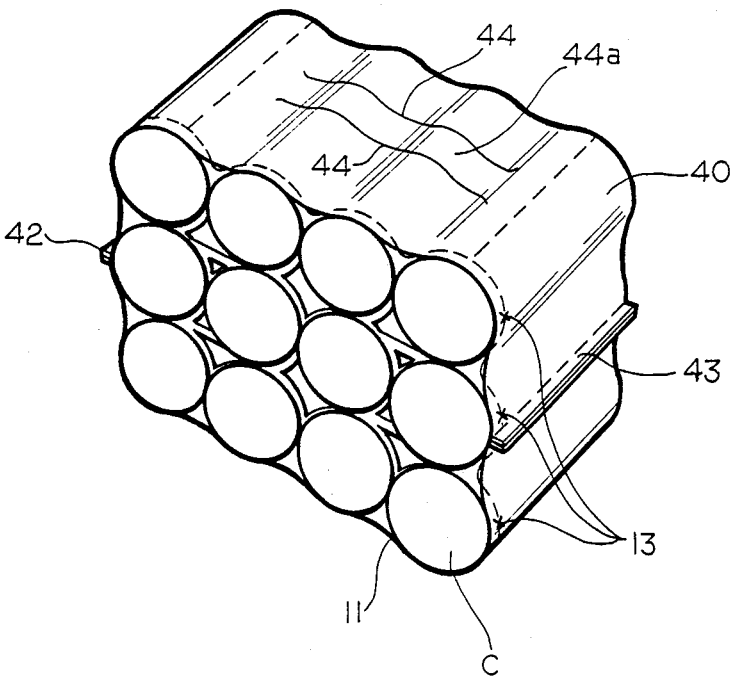
FIG. 9 is a perspective view of another form of can package.

The form shown in FIG. 9 includes a band 40 similar to that shown in FIG. 5 except that it is made of a second layer 41 having a length equal to one side and is bonded as at 42, 43 beneath or inside of the band. After this bonding slits 44 are formed in both layers 40, 41 to define a double layer handle 44*a*.

In the form of can package set forth in FIG. 10, the band 46 has openings 46 extending transversely across its end portions 47. When end portions 47 are bonded to one another along the inner surface 48, a handle is defined. The handle extends outwardly from the end of the package which comprises three cans when the band is stretched over twelve cans.

In the form shown in FIG. 11 the handle 51 is made of separate material such as paperboard which is thicker than the plastic material of the band 50. Narrow portions 52 of the band 50 are bonded to the exterior of the handle 51 to complete band 50 for stretching over a group of cans. The handle 51 has a transverse finger receiving opening 53.

In the form shown in FIG. 12, the band 45 of FIG. 10 is provided with a handle reinforcement 51*a*, like that of FIG. 11 between the end portions 47. End portions 47 are then adhered to the handle reinforcement 51*a* to provide the completed band for stretching over a group of cans.

It is noted that in the forms shown in FIGS. 10–12, since the handle is on the short side of the package, the bonds to the carrier will be along the long sides, designated X in FIGS. 10–12.

It can thus be seen that there has been provided a can package for cans in large numbers, such as twelve cans, which utilizes a conventional flat plastic carrier over the ends of the cans and a wide band about the bodies of the cans which results in a package that facilitates the handling of the group of cans and at the same time provides ample space for promotional graphics and the like; which carrier also includes a handle; which is durable when wet; which utilizes a minimum of material; which is less bulky minimizing the problem of disposal; which provides a more attractive glossy surface for display of graphics; which can utilize existing equipment for applying the carrier on the ends of the cans; which completely protects the cans from abrasion and clearly distinguishes the number of cans in the package; and which is low in cost.

We claim:

1. A one-piece tubular band of plastic material adapted to be stretched about the periphery of a group of cans, said band comprising spaced circumferentially extending slits in said band extending longitudinally of said band to form a handle, the length of said slits being such as to span the space between at least a pair of cans such that the fingers can be inserted through one slit in the space between a pair of cans to engage the band and thereafter through the other slit to carry the can package about which the band is stretched.

2. The band set forth in claim 1 wherein said band comprises a single panel having end portions in overlapping relation and bonded to one another to define one side of said band, said circumferentially extending slits extending through said overlapping portions such that said handle comprises double layer handle portions that can be grasped for carrying the package.

3. The band set forth in claim 1 wherein said band comprises a single rectangular portion having free ends bonded to one another, a portion of the band having said spaced slits thereon defining said handle.

4. A can package for a plurality of cans comprising a group of cans in side by side relation, a carrier having openings stretched over the upper ends of the cans, a one-piece tubular band of plastic material stretched about the periphery of the group of cans, and said band having spaced circumferentially extending slits in said band extending longitudinally of said band to define a handle, said slits extending transversely along a portion of a side of said group of cans, the length of said slits being such as to span the space between at least a pair of said cans such that the fingers can be inserted through one slit in the space between a pair of said cans to engage the band and thereafter through the other slit to carry the can package about which the band is stretched.

5. The can package set forth in claim 4 wherein said group of cans comprises twelve cans in an array of the three rows of cans, four cans in each row.

6. The can package set forth in claim 4 wherein said band comprises a single rectangular portion having free ends bonded to one another, a portion of the band having said spaced slits therein.

7. A tubular band of plastic material adapted to be stretched about the periphery of a group of cans, said band comprising spaced circumferentially extending slits in said band extending longitudinally of said band to form a handle, the length of said slits being such as to span the space between at least a pair of cans such that the fingers can be inserted through one slit in the space between a pair of cans to engage the band and thereafter through the other slit to carry the can package about which the band is stretched, said band comprising a single panel having end portions in overlapping relation and bonded to one another to define one side of said band, said circumferentially extending slits extending through said overlapping portions such that said handle comprises double layer handle portions that can be grasped for carrying the package, said overlapping band portions being bonded to one another transversely of said band along opposite sides of said handle forming portions.

8. A can package for a plurality of cans comprising a group of cans in side by side relation, a carrier having openings stretched over the upper ends of the cans, a tubular band of plastic material stretched about the periphery of the group of cans, and said band having spaced circumferentially extending slits in said band extending longitudinally of said band to define a handle, said slits extending transversely along a portion of a side of said group of cans, the length of said slits being such as to span the space between at least a pair of said cans such that the fingers can be inserted through one slit in the space between a pair of said cans to engage the band and thereafter through the other slit to carry the can package about which the band is stretched, said band comprising a single panel having end portions in overlapping relation and bonded to one another to define one side of said band, said circumferentially extending slits extending through said overlapping portions such that said handle comprises double layer handle portions that can be grasped for carrying the package, said overlapping band portions being bonded to one another transversely of said band along opposite sides of said handle forming portions.

* * * * *